United States Patent [19]

Adams

[11] Patent Number: 4,639,217

[45] Date of Patent: Jan. 27, 1987

[54] COUNTERCURRENT HEAT TRANSFER DEVICE FOR SOLID PARTICLE STREAMS

[76] Inventor: D. Carlos Adams, 25 W. 280 High View Dr., Naperville, Ill. 60540

[21] Appl. No.: 691,494

[22] Filed: Jan. 14, 1985

[51] Int. Cl.[4] ..... F27B 7/08; F27B 7/10

[52] U.S. Cl. ..... 432/107; 110/226; 110/246; 165/89; 165/90

[58] Field of Search ..... 165/87, 88, 89, 90, 165/91, 111 DC; 432/107, 118; 48/89; 208/126, 11 R; 75/34; 110/226, 246

[56] References Cited

U.S. PATENT DOCUMENTS

| | | | |
|---|---|---|---|
| 3,056,588 | 10/1962 | Alexandrovsky | 165/88 |
| 3,481,720 | 12/1969 | Bennett | 48/89 |
| 3,787,292 | 1/1974 | Keappler | 432/107 X |
| 4,361,100 | 11/1982 | Hinger | 110/246 X |
| 4,441,906 | 4/1984 | Propster et al. | 165/88 X |

*Primary Examiner*—Edward G. Favors

[57] ABSTRACT

A rotary kiln is formed by a helical tube secured inside a cylindrical shell, and fitted with flow spoiler baffles between each turn of the helical tube. Inside the helical tube, one solid particle stream flows uphill in the manner of the classical Archimedes screw. Another stream of particles is tumbled by the flow spoiler baffles and flows under gravity downhill through the center of the helical tube, tumbling over the successive convolutions of the helical tube. This downhill flow occurs because the particles collide with the interflute spoiler baffles, tumble and fall off the helical flutes, thus causing the countercurrent flow. A wide range of surface-to-volume ratios of, and heat transfer through, the helical tube may be achieved by a proper design of the relative width of the tube. This helical tube in a drum device provides heat transfer for a varied number of process applications, such as oil shale or tar sands retorting. Oil vapor is generated in one stream responsive to the heat of combustion or gasification of the spent char in the counterflowing stream. Heat from the combustion and the sensible heat of the ash is transferred through the wall of the helical tube to the inflowing stream with no stream intermixing.

20 Claims, 7 Drawing Figures

COUNTERCURRENT HEAT TRANSFER DEVICE FOR SOLID PARTICLE STREAMS

This invention relates to heat exchange systems and heat treatment of solid particle materials, and more particularly, to means for and methods of heat processing solid materials and recovering the heat such that both the input and output streams of particle materials are relatively cold.

There are many solid materials which are heated in order to process them. By way of example, pulverized oil shale and tar sands are heated to distill off vapors which are collected to produce useful hydrocarbons. Many other solids are also heated during their processing. Therefore, in the following description, it will be convenient to describe certain examples, however, the invention is not limited thereto.

The *Chemical Engineering Handbook,* 5th Ed. Section 20, page 39, lists several applications for rotary kilns including the following which are used in the temperature range applicable to the present invention:

VERMICULITE. A micaceous mineral is roasted to cause exfoliation for use as an insulating material (570° F).

POTASSIUM SALTS. In this operation, potassium chloride is introduced to the rotary kiln and brought to the fusion temperature of 1427° F.

MAGNESIUM OXIDE. The natural minerals, magnesite, brucite, etc., after being crushed to a predetermined size, are calcined at temperatures varying above 1440° F. Magnesium hydroxide, recovered from sea water or salt brine, is also being treated in a similar manner except that it is added in the form of a sludge.

SODIUM ALUMINUM SULFATE. This product is now being successfully calcined in rotary kilns. In this process, the salt cake is broken up just prior to entering the kiln. Temperatures employed are approximately 1000° F.

MERCURY. In recovering mercury from cinnabar ores, the ore is crushed to minus ½" and fed to rotary kilns where it is calcined to over 1000° F. Since the mercury exists as mercuric sulfide, the sulfur is oxidized to sulfur dioxide and the mercury vaporized. The gases are passed through cooling chambers where the mercury condenses and is collected. Mercury vaporizes at 680° F.

GYPSUM. The rotary kiln is rapidly replacing the kettle in producing plaster of paris. Great care is required as the temperatures for reaction are low and within narrow limits, 228° to 267° F.

These and other processes could have heat efficient application in the inventive energy recovery countercurrent rotary kiln. Accordingly, the invention provides a system wherein both the unprocessed input stream and the processed output stream of solid particles are relatively cold, so that the major process heat in the system is recovered and used.

Heat transfer devices applied to fluids can achieve a high surface-to-volume ratio between countercurrent streams. Consequently, they have wide application and achieve relatively high coefficients of heat transfer because of the nature of a fluid to make a close, continuous contact with interfacing surfaces. This is not so with solids. There is a considerable void or interparticle space as well as void space between the interfacing wall and particles. Solids cannot be pumped through small tubes to obtain a high contacting surface-to-volume ratio as with fluids. These and other effects make heat transfer between streams of solids a problem of significant proportions.

In an effort to address problem, rotating kilns have been proposed to achieve transfer between streams of solids. Several patents utilize a countercurrent movement of solids and some achieve some heat recovery, but low interfacing area between the counter-flowing streams is typical and heat recovery is limited.

The Bennet Patent, U.S. Pat. No. 3,481,720, assigned to Sun Oil Co., describes a countercurrent rotating kiln for the distillation of solids such as oil shale. It consists of a group of three concentric cylinders with some initial heatup occurring in the center one, retorting in the next outer cylinder and combustion of residual coke in the outside cylinder. Because of the low interfacing surface areas between the concentric cylinders it requires recycled ash to be mixed with the raw shale to achieve shale retorting temperatures. Augers between the cylinders move the solids through the cylinders. Concepts involving ash recycling in a rotating kiln are also used by the UMATAK CO. (U.S. Pat. No. 4,180,455) and PEDCO CO. (See, R. K. Harris, *Synfuels from Oil Shale, Tar Sands* Symposium Proceedings, Inst. Gas Tech., Chicago, Ill., 1983 (pages 473–488)).

Several non-kiln processes have been proposed to use recycling heat carriers to transfer heat. Most of these consider the spent ash to be the most practical heat carrying medium. The Lurgi-Ruhrgas process is one such concept. The cold oil shale is mixed with 1200° F. hot recycle ash and pyrolyzed during mixing in a screw conveyor which dumps the mix in a surge bin from which one part is discarded at 750° F. (or higher) and six to eight parts are recycled with air which burns coke from the residue raising the temperature to about 1200° F. whereupon it is mixed again with cold shale. (See, *Synthetic Fuels Data Handbook,* 2nd Ed., Cameron Eng., Denver, Colo. (pages 84 and 292)).

It may be pointed out that, to the credit of solids recycling retorts, heat is more effectively and completely transferred by mixing the hot recycled solids directly with the non-retorted solids than by resorting to indirect heat transfer through an interfacing wall as in this invention. However, there are serious disadvantages associated with recycling hot spent solids which include the following:

1. The recycling solids add to the solids handling problems with the associated reduction in handling capacity, increased solids wear on equipment, and increased energy required for recycling.

2. The recycling ash also detracts from the yield efficiency because of the added presence of the hot surfaces which act as added coking surfaces increasing the tendency of the shale oil vapor to form coke.

3. As the *Synthetic Fuels Data Handbook* points out (2nd Ed., p. 292), all of the recycled hot solid must eventually be discarded hot and this is energy lost (without an efficient heat transfer device, such as is the subject of this invention).

There are also designs for retorts in which the recycling solid comprises refractory balls or pebbles of larger size than the oil shale particles so that the balls can be trommel separated for recycling. Shell Oil Co. U.S. Pat. No. 4,110,193 and many TOSCO patents beginning with U.S. Pat. No. 2,877,106, are examples of recycle ball heaters. The TOSCO II retort is thought to be the only one of these units developed beyond the conceptual phase. Difficulties with the ball heater units make them marginally effective, consequently it is thought that TOSCO has indicated that it is planning a TOSCO V retort which uses recycle ash, as the heat carrier.

An object of this invention is to provide new and improved means for and methods of transferring heat between two counterflowing streams of solid particles, but without direct contact or intermixing of the two streams.

A further object of the invention is to provide a counterflowing stream of solid particles in a retort for recovery of synthetic fuels. Here, an object is to approach the ideal of cold material in both the inflowing and the outflowing streams of solid material.

Another object of the invention is to provide a counterflowing heat exchanger having general utility in many solids processing systems which use heating as an essential step.

In keeping with an aspect of the invention, these and other objects are provided by a novel process for making a heat transferring contact between two streams of solid particles which flow in countercurrent fashion, while precluding all mixing between the two streams. Nearly all of the heat is transferred from an outgoing stream of hot material to an incoming stream of cold material. This is accomplished by means of a helical tube secured inside a cylindrical vessel, fitted with baffles between each flight or turn of the helix. Inside the helical tube, one particle stream flows uphill in the manner of a classical Archimedes screw. The other stream is tumbled by the interflight baffles, and flows downhill, falling through the center of the shell, thus achieving countercurrent flow.

For the purpose of this description, the term "interfacing shell" refers to a fluted enclosure or a wall of said enclosure, which is inside of a large cylinder or enclosing housing. The interfacing shell acts as a separating divider between two streams of flowing solids but also acts to transfer heat between the two separate streams. "Shell" or "center" refers to the space inside of the interfacing shell. The term "hull" refers to the space inside the large cylinder but outside of the interfacing shell. Thus, the space inside the hull or helical tube plus the space inside the interfacing shell comprises the total volume of the kiln. "Flight" is used in reference to the individual cycles or repeating sections of the interfacing shell. "Flute" refers to a groove or channel between adjacent flights in the interfacing shell which is used to increase the surface area and/or to facilitate the flow through the device. The term "spoilers" refers to the baffles attached inside the interfacing shell between the flights of the helix. "Mixer" baffles refer to tumbling projections inside the interfacing shell and in the hull or helical tube.

Many solid mineral fuels, such as oil shale and tar sand consist of a mineral (non-organic) fraction and an organic part. As used here, "bitumen" refers to the organic matter locked in an earth solid, such as oil shale, tar sand, lignite, coal, etc. "Retorting" is the process of pyrolysis which converts the organic portion to coke plus a condensable oil vapor. "Char" is used here to refer to the spent or retorted oil shale, tar sand, etc., which consists of a mineral portion and the coke from the pyrolyzed bitumen. "Ash" refers to the char after it has been burned or gasified so that the coke is substantially removed from the mineral fraction.

The invention will best be understood by reference to the following specification, taken with the attached drawings, in which.

Figure 5:
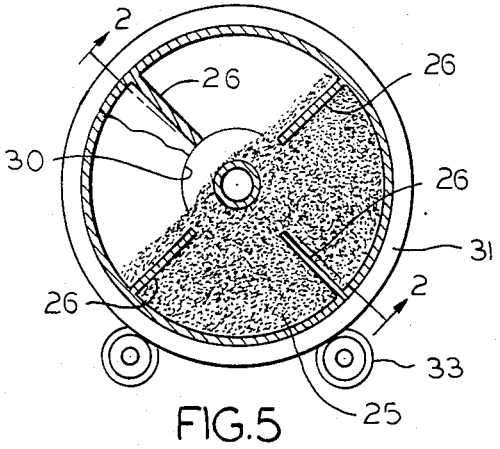
FIG. 5 is a cross section of the drum taken along line 5—5 of FIG. 1 showing the shell stream of particles being tumbled by interflight spoiler baffles between the turns of the helix.
Figure 6:
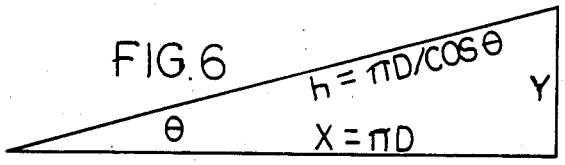
Figure 7:
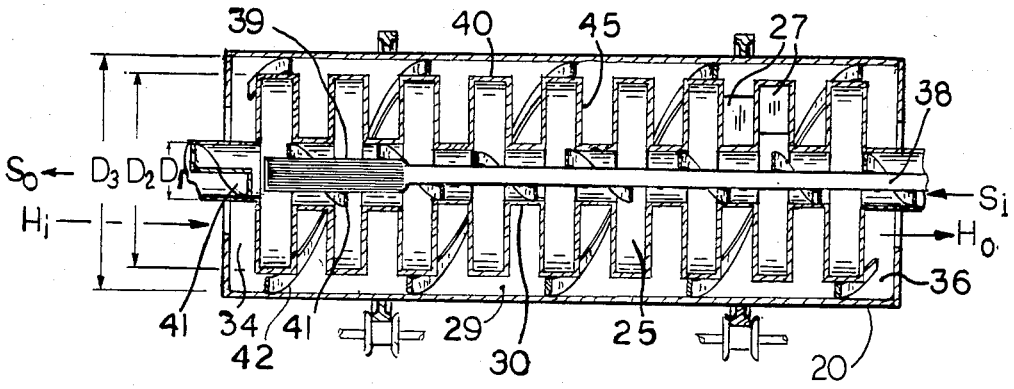

FIG. 6 is a geometrical figure which shows the dimensional calculations of the length of one turn of the helix, $\pi D/\cos\theta$, relative to the helix diameter, D, the cycle width Y, and the pitch angle $\theta$; and FIG. 7 is a longitudinal cross section of a special variation of the design of the invention where the flute pitch angle $\theta=0$. Its operation and function is similar to the design described in FIGS. 1–6, but it can operate in a horizontal position.

The inventive structure (FIGS. 1–5) comprises a hollow cylindrical drum 20, fitted with two or more support tires 31 (FIGS. 4–5) which rotate on bearing rollers 33 with drum rotation being about an axis 23 that is tipped at an inclination angle with respect to the horizontal 21. The drum 20 may have either a unitary shell or be made from a ribbon attached to the helix and closing the space between adjacent flights.

Figure 1:
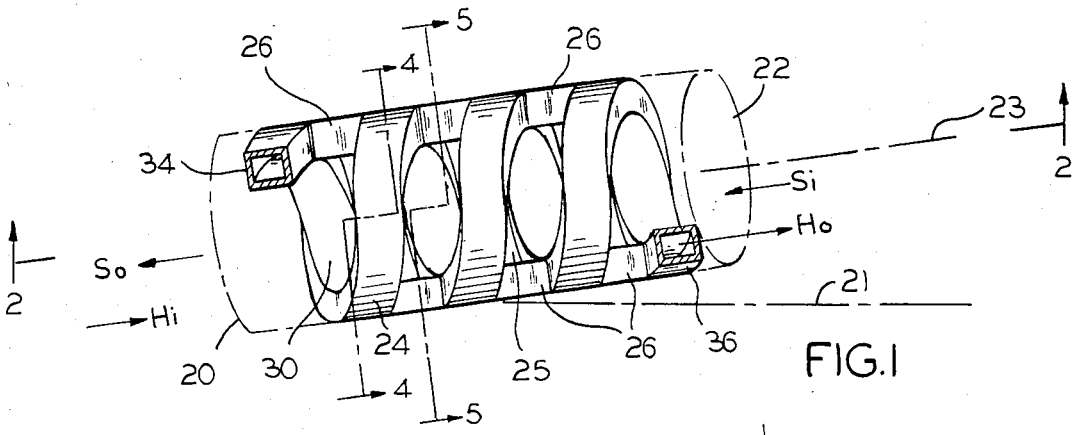
FIG. 1 is a perspective view of the inventive heat transfer device.

From an inspection of FIG. 1, it will be obvious how the bottom of each helix flight encloses and moves batches of material uphill, as the drum turns, after the manner of the Archimedes screw. Solid particles 29 enter the helix in batches via entrance 34, move up the incline and are expelled from the helix open end 36 in response to the drum rotation. Because of this batch movement, the dwell time is substantially uniform for all the particles in the helix.

The flow rate through the shell is a function of the inclination angle which may be adjusted for this purpose. If the angle is 0°, the shell flow rate will be very low, governed only by the differential fill height between the entrance and the exit. If the angle is too large, the uphill flow through the helix will discontinue. The maximum operable angle depends on the particle characteristics, but 40° is thought to be a practical maximum limit. The normal operating range is between these two limits (i.e. 0° to 40°).

The helical tube 24 inside the drum is in the form of an open, hollow, sheet metal tube, preferably with a generally rectangular cross section. As seen by comparing the cross sections in FIGS. 2 and 3, both the radial height and longitudinal width of the helical flute cross section 24 may be made relatively wide or narrow to provide as large a surface-to-volume ratio (and the resulting large heat transfer) as the economics of the design and operation may dictate.

Figure 2:
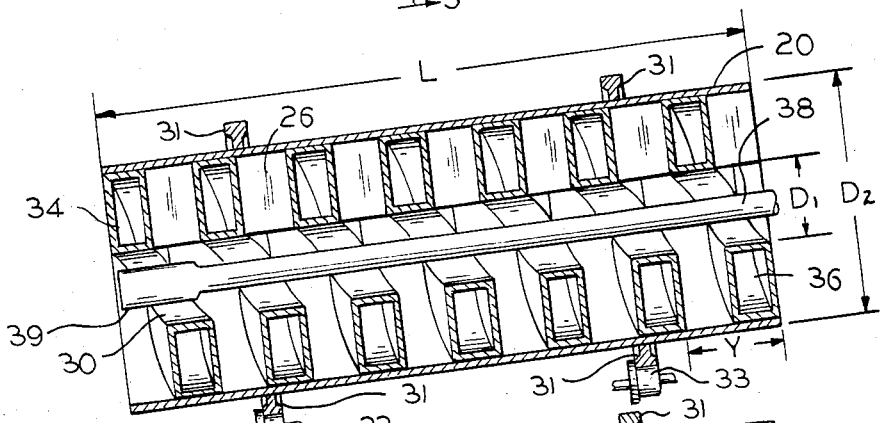
FIG. 2 is a longitudinal cross section, taken along line 2—2 of FIGS. 1 and 5, which shows a helix, with a relatively coarse thread or large pitch angle (i.e., the angle measuring the coarseness of the helical coil)
Figure 3:
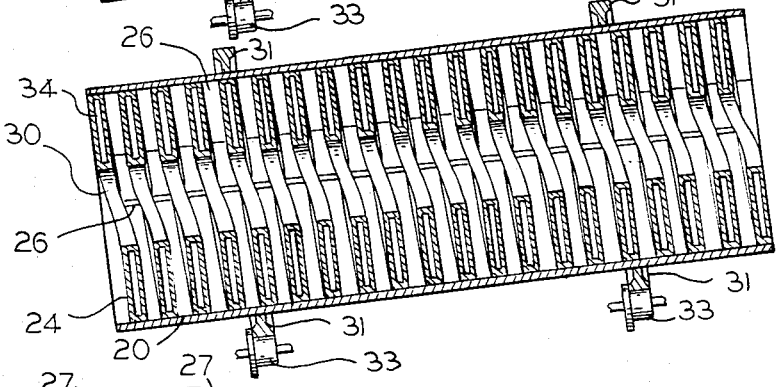
FIG. 3 is a similar cross section showing the same kind of helix, but with a fine thread or small pitch angle.

Calculations of the heat transfer area, kiln volume and load are obtained as follows:

CALCULATIONS FOR AREA OF INTERFACING SHELL $D_1$, $D_2$, L, and Y are defined in FIG. 2, and Y=Width of one cycle of the helix $=L/N=\pi D \tan\theta$.

N=Number of turns or cycles of the fluted interfacing shell.

FIG. 6 shows the relationship of the helix circumferential length for any diameter D, cycle width Y, and pitch angle $\theta$.

$A_s$=Area of center cylindrical spiral$=\pi D_1 L-w)$, where w=Ratio of helical tube or large, shallow drum width to cycle width, $A_f=\pi D_2^2(-R^2)N/\neq\neq 2$ =approximate area of sides of helix, and $R=D_1/D_2$. This would be the area if pitch angle $\theta=0$.

$A_t$=Total area, $A_s+A_f=\pi D_2^2(1-R^2)(-1+e)N/2+\pi D_1 L(1-w)$ where e =error fraction due to greater than $\theta$ helix pitch angle.

$A_f$ would be too small by the fraction, e, which is usually less than about 5%. The value e can be calculated from:

$$e=1-\cos\theta \text{ and } \theta=\text{Arctan } L/N\pi D$$

The Average value e can be calculated by integrating e numerically from the above relationships from $D_1$ to $D_2$. The average e can also be estimated, only slightly too large, from the log mean avg. e (LMA)$=(e_1-e_2)/\text{Ln } e_1/e_2)$ and for most cases this reduces the error in $A_f$ to $<1\%$.

$A_t$ for the configuration in FIG. 7 is given by the relation:

$$A_t=\pi D_2 N(D_2(1-R^2)/2+Y(w+R(1-w))$$

VOLUME AND LOAD CALCULATIONS $V_t$=total volume$=\pi D_3^2 L/4$ and $D_3=D_2$ for FIGS. 1-5

$V_s=(1-w(1-R^2))V_t$=Shell volume, FIGS. 1-5, or $V_s=\pi D_2^2(w+R^2(1-w))L/4$=Shell volume, FIG. 7

$V_h$=Hull volume$=V_t-V_s$ $G_h$=Hull load$=F_h V_h d_c$, where $d_c$=loose bulk density of char $F_h$=Hull load fraction $G_s$=shell load$=F_s V_s d_s$, where $F_s$ is the load fraction in the shell and $d_s$ is the loose bulk density of the oil shale.

$G_t$=total load$=G_s+G_h$.

A special variation of the design of the invention is the case where the flute pitch angle $\theta=0$. In this case, shown in FIG. 7, the interfacing shell between the two streams becomes a series of large, cylindrical sections or shallow drums 40, of diameter $D_2$, and smaller cylindrical sections 30, of diameter $D_1$ interconnected by means of annular sections 45.

One advantage of this configuration is that the device would be easier to construct; however, two features detract somewhat from the efficiency described previously. First, because the outer stream does not move in batches, it would not have completely uniform residence time; therefore, movement through the outer stream 29, is somewhat less efficient than through said helical tube. Also, auger blades are necessary to move the solids longitudinally. This, in turn, requires that the large interface diameter, $D_3$ of the kiln must be smaller than the kiln diameter, $D_2$, to allow space for outer auger blade 42. A center auger blade 41, facilitates movement of inner stream 25. Rotation of the kiln moves the inner and outer streams in counter-current directions responsive to the opposite pitch of the auger blades. Auger blades with pitch in the same direction could also move said streams in cocurrent motion if the application is required.

In the construction of the inventive device, the material can be selected on a basis of its high temperature strength and corrosion resistance. For example, high nickel alloys, can tolerate temperatures up to about 1800° F. However, the temperature on one side of a wall may be hotter than the limit, if that on the other side is cooler. The successive flights, convolutions or coils of the interfacing shell or helix may be fixed in any suitable manner inside of and attached to the cylindrical drum 20, such as by welding, for example.

Figure 4:
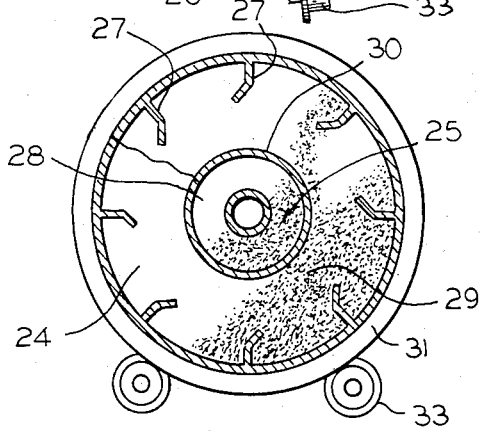
FIG. 4 is a cross section of the helix, taken along line 4—4 of FIG. 1, showing internal mixing baffles within the helix for tumbling and mixing the helix stream of particles as it moves uphill through the kiln in the manner of an Archimedes screw.

Spoiler baffles 26 are attached in any suitable manner to the inside of the cylinder 20 (in both FIG. 2 and FIG. 5). These spoiler baffles are located between each successive flight of the helical tube 24, to disallow the Archimedes screw upward flow in the shell. Instead, they tumble the particles 25 (FIG. 5) outside the helix, thus disallowing movement up the incline. As seen in FIGS. 1-5, gravity moves the particles through the center of the shell 28, toward and into the bottom end of the drum. On a probability basis, all of the particles 25 should reach the exit of the drum 20 after approximately the same dwell time.

Other mixing baffles 27 may be positioned inside of, welded to, or otherwise associated with the outer peripheral walls of the helix or hull, (see FIGS. 2 and 4) and in the flutes and the shallow drums of the interfacing shell (FIG. 7 ). Two representative baffles are shown in FIG. 7. From FIG. 4, it is seen that baffles 27 are positioned at multiple locations (e.g., every 45°) around the inside of the perimeter of the helix or hull. This way, the particles inside the helix or hull are tumbled and mixed as they move through the kiln. This helps to improve the heat transfer to the wall and to minimize particle agglomeration effects.

Thus, in its general application, the invention provides a means for achieving effective heat transferring countercurrent flow between two streams of solid particles, but without mixing the two streams together.

SIMPLE COUNTERCURRENT HEAT TRANSFER OPERATION

This system may operate as a simple heat transfer unit for two separate and distinct streams of solids. Or, it may function as a high efficiency closed end kiln, as described below. As a simple heat transfer unit, each of the counterflowing streams enters into and exits from the unit at opposite ends of the shell and hull (i.e., in at shell input $S_i$ and hull input $H_i$ and out at shell output $S_o$ and hull output $H_o$, respectively, FIGS. 1 and 7). Thus, a hot stream enters the shell at input $S_i$ and is tumbled through the shell giving up its heat to the cold stream which enters the hull input $H_i$, at the opposite end. The cold stream moves through the hull increasing in temperature as it receives heat from the hot stream and exits at the hull output $H_o$, nearly as hot as the temperature of the first stream entering at shell input $S_i$. Of course, the temperature differential between the streams depends on the kiln design (interfacing shell area and helix or auger blade pitch angle) and operating parameters (kiln revolutions per minute, load fraction and inclination angle).

For example, hot spent char directly from an oil shale retorting process, such as one of several ash recycling processes (referred to previously), could enter the inventive shell input $S_i$ at the hot end at about 950° F. and exit cold from the shell output $S_o$. At the same time, a stream of cold oil shale could enter the hull input $H_i$ at the cold end, heating as it proceeds through the hull and then dump out the hot end from the hull output $H_o$ ready to be mixed with the hotter (e.g. 1250° F.) recycled ash. Thus, having preheated the cold feed shale to about 750° F., the shale could enter a mixing device where it would mix with the 1250° F. recycle ash and be raised to the final reaction temperature, 950° F. Thus, the recycle ash duty would be reduced from heating the cold shale approximately 900° F. (i.e. 950° F. minus 50° F. ambient) to a mere 200° F. (950° F. minus 750° F.) and the recycle ash requirement would only be 22% of the original requirement (200/900=22%).

This combination would greatly improve the efficiency of the ash recycling process. The char fed to be burned would be much richer in coke, having been diluted with only 22% as much recycle ash, so that char gasification could be improved. Ash recycling energy would be reduced. Because oil coking occurs on hot ash surfaces, the reduction in ash present in the ash recycling retort would allow an increase in the oil yield. In addition, the leanness limit of oil shale (i.e., the leanest shale which could be processed without supplementary heat) would be very significantly reduced.

However, greater efficiency can be realized by eliminating the ash recycling retort altogether and performing the entire retorting operation in the inventive kiln as described later in this disclosure.

DESCRIPTION OF CLOSED END KILN OPERATION

In the inventive closed end kiln, the inlet stream flows once through the kiln while heating to the process temperature and then reverses direction flowing back upon the inlet stream in indirect contact, transferring the process heat from the outlet stream to the inlet stream. The result is a novel energy efficient process kiln.

As a closed end kiln, this invention can be operated in one of two countercurrent modes where both streams enter and exit the same end. (The closed end is also referred to as the hot end because it would normally be hot to achieve the purpose of the kiln process. "Open end" does not mean that the retort is open to the atmosphere, but that it is open in the sense that the solids enter and exit through this end).

The following description is for the helical kiln (FIGS. 1-6), but the same application can apply to FIG. 7.

MODE 1: OPEN END ELEVATED: A stream enters the elevated end of kiln 20 in the center or shell side at shell input $S_i$ and tumbles to the low (hot) end falling through the center of the shell. At the closed low end, it is scooped at 34 into the helix. The shell output stream $S_o$ becomes the helix input stream $H_i$. After the particles return through the helix, to the upper end, the material exits the kiln at helix output $H_o$ from the upper end 36 of the helical tube.

MODE 2: CLOSED END ELEVATED: In this alternative, the flow is reversed from Mode 1. The cold stream enters the helix input $H_i$ at the kiln cold (low) end, the entrance being through the helical side at open end 34, flows uphill in the helical side towards the hot end and at the top, dumps from open end 36 into the shell side, moves down through the shell and exits as a stream of cold particles at the shell output $S_o$.

The closed end kiln based on FIG. 7 functions similarly as in modes 1 and 2. Except as stated, the operating position may be closer to horizontal.

During the flow of the particles through the inventive kiln, heat may be supplied in any of a number of different ways. In a synthetic fuel retort, the charred particles contain a combustible coke wholly contained in one of the streams of solid particles, either in the hull or in the shell, depending on the operational mode. If the process material is not combustible, heat may be added by directly flowing a burning combustible gas, liquid or solid fuel with one of the streams usually the inlet stream. Thus, combustible material is burned with air or oxygen fed into the burning stream. For example, in an application as a gypsum kiln, a relatively small burner of natural gas could be added to a stream of gypsum in the hot end of the shell, the stream having entered the shell at its input $S_i$. Final calcining of the plaster would occur at the hot end where the plaster enters the hull side 34, where it would return to open end 36, giving back most of the sensible heat to the inflowing gypsum.

APPLICATION AS AN OIL SHALE RETORT

One of the most ideal applications for the inventive countercurrent closed end kiln is its application as a retort for oil shale, tar sands, and the like. As such, the preferred mode of operation is with the entrance at shell input $S_i$ and exit at hull output $H_o$, respectively. A stream of cold oil shale particles 25 entering the center input $S_i$ of the shell is heated to pyrolysis temperature in the shell center as it moves through the shell after which the spent oil shale char is scooped batchwise or dumped into the helix or hull 34 at the closed end where it becomes stream 29 and moves back through the kiln in the helix or hull, cooling as it proceeds until it is dumped at hull output $H_o$ from the cool end 36 of the retort.

Air and steam are piped into the hull at the cold end. Flowing countercurrent to the solids in the hull, the air/steam mix is heated, by contact with the hot solids, to combustion temperature which begins at about 550° F., for Greenriver oil shale char. As the air/steam mix continues through the hull, it contacts and gasifies the hot char which action elevates the temperature and furnishes the retorting heat. The gasification product and nitrogen from the air may exit through a vent pipe (not shown) near the hot (closed) end of the retort and may be piped to the cold end of the shell side giving up the heat to the inflowing oil shale and may then be piped from the shell to be burned as a low btu utility gas.

The operating parameters are adjusted, for Greenriver oil shale, to maintain the maximum char combustion temperature below 1400° F. and the pyrolyzing oil shale maximum temperature below 1000° F. These parameters are the revolutions per minute of the kiln, the air and steam flow rates, air/steam ratio, and ore richness, etc.

As shown in FIG. 4, the bottom of the helical channel passageway may be completely filled with solid particles so that a flow of fluid (vapor or gas) cannot bypass through the fill section of the passageway. The volume of the helical flute is controlled by both the flute width and the major and minor diameters of the flute. These dimensions are adjusted so that there is relatively more volume in the passageway within the body of the kiln as compared with the volume within the passageway at the two opposing ends of the kiln. Since the passageways at the opposite ends are maintained full or at a maximum capacity of solid particles, there is minimal space for the fluid to pass through except in the central portion of the helical passageway. Thus, the filled ends form air or fluid locks which have the effect of isolating the fluids in the center portion.

Fluid enters the end zone of the helix, just inside the inlet, $H_i$, where approximately the two end flights of the flute act as a buffer to separate the shell pyrolysis gas from the char combustion product gas. Thus, a fluid leakage is controlled from both ends. This also applies to air and combustion product gas ($CO_2$, CO, $H_2$, $N_2$ and $H_2O$).

Oil vapor generated from the pyrolysis of the oil shale exits through a vapor vent pipe 38 inserted from the cold end into and through the center of the retort. Dust from the retort is excluded from the vent pipe by means of a dust filter 39 at the hot end of the pipe. The vapor outflow is countercurrent to the inflowing oil shale and water streams and this feature helps to recover the heat of the oil vapor and to quickly and significantly reduce the temperature of the vapor before it leaves the retort. This is important in order to minimize the coking tendency of the oil vapor.

The efficiency accruing from the combination of these features enables an economic retorting of very lean ore, without the addition of heating fuel. The following calculations show that low grade mine discard oil shale with only 2% organic content contains sufficient energy in the char that only 70% of the coke need be burned for the heat requirement. Ore grades of 5%, 10%, and 15% organic content require 31%, 18%, and 13%, respectively, of the coke be burned to provide pyrolysis and sensible heat, the remainder being available for the production of low btu utility gas. A vast reserve of oil shale, tar sands and the like will become economically recoverable with the invention device which would not be otherwise usable.

OIL SHALE/TAR SAND PYROLYSIS HEAT DATA

Basis: 100 pounds of oil share or bituminous sand

Assume:
1. 20% conversion of bitumen to coke[a].
2. Feed temperature of 77° F. Spent ash rejection temperature of 250° F.[b]. Countercurrent Avg. differential Temp. = 300° F.
3. No credit taken for excess heat available from $CO_2$ product over that of $O_2$ feed (11.2 vs. 7.7 btu/mole °F. respectively[c].

| | CASE I (discard) | CASE II (very lean) | CASE III (lean) | CASE IV (medium) |
|---|---|---|---|---|
| CALCULATION OF HEAT AVAILABLE | | | | |
| Bitumen (organic) Content: (lbs or %) | 2 | 5 | 10 | 15 |
| Bitumen coke (lbs or %) | .4 | 1 | 2 | 3 |
| Heat available (btu) @ 14,000 btu/lb | 5,600 | 14,000 | 28,000 | 42,000 |
| CALCULATION OF HEAT REQUIRED | | | | |
| Ash ejected at 250° F.[b] (lbs) | 98 | 95 | 90 | 85 |
| Sensible heat ejected (btu) @ 37 btu/lb[d] | 3,626 | 3,515 | 3,330 | 3,145 |
| Kerogen heat & pyrolysis (btu) @ 160 btu/lb[e] | 320 | 800 | 1,600 | 2,400 |
| Total heat required (btu) | 3,946 | 4,315 | 4,930 | 5,545 |
| RATIO OF HEAT REQUIRED TO HEAT AVAILABLE | 70% | 31% | 18% | 13% |

[a]Synthetic Fuels Data Handbook, 2nd Ed., Cameron Eng., Denver Colorado, P. 46.
[b]Low differential temp. at end due to narrow end flute width.
[c]O. A. Hougen, et al. Chem. Proc. Prin. I, 2nd Ed. (1964) P. 258.
[d]Wise et al. USBM, RI-7482, Laramie.
[e]E. W. Cook uses 60 cal/gm (108 Btu/lb) for kerogen pyrolysis — Colorado School of Mines Qtrly. 65, n. 4, (1970). This more liberal estimate allows for some heat loss in the effluent oil.

Some of the advantages of this retort are:

1. Effective recovery of heat from spent ash by countercurrent contacting of hot char gasifying stream with the retorting oil shale stream.
2. Gasification energy provides heat in close though indirect contact for pyrolysis of oil shale/tar sand.
3. Normal levels of residual coke will allow for utility gas production beyond the energy requirements to operate the retort.
4. Simple operation resulting from a compact design which combines into one integral unit the several operations of:
   (a) ore preheating,
   (b) ore pyrolysis,
   (c) char gasification, and
   (d) heat recovery from spent ash.
5. Effective indirect heat transfer between the two streams eliminating the necessity to recycle hot ash. This effect is to:
   (a) decrease the energy for recycling the ash,
   (b) decrease the wear on equipment,
   (c) decrease the generation of fine ash,
   (d) increase the oil yield by minimizing oil coking on the ash,
   (e) maintain separate the high btu pyrolysis gas from the low btu char gasification gas,
   (f) eliminate coking and vapor burning which occurs from the presence of small amounts of oxygen in internal combustion retorts.
6. Plug flow (i.e., uniform residence time for all the particles) occurs in the helix and near plug flow is achieved in the shell section.
7. Due to the highly heat efficient operation, exceptionally low grade ore can be economically retorted making discard grade ore amenable to recovery. This will make mining more efficient and strip mining more attractive by reducing the overburden-to-ore ratio.
8. Minimal heat loss. Due to items 1–4, the unit can be well insulated so that significant heat loss is only in the low temperature materials discharged to the environment.
9. A wide range of ore richness can be retorted in the same kiln.
10. Wide range of particle sizes allowable. Fine grinding not required as with most fluidizing retorts. "Walnut" is good size.

11. Since fine grinding is not necessary, the resulting ash is not as fine and will be relatively easy to process, separate, handle, discard and control after discarding.

12. Mechanical fluidization by rotating the kiln is simpler and more economical than recycling large amounts of gas for fluidized bed and/or gas conveying of solids.

13. Low profile plant design. High support and superstructure associated with many other plant designs not necessary.

14. Low (near atmospheric) pressure.

15. No moving parts inside of kiln (screw feeders, mixers, valves, etc.).

16. Due to simplicity of device (items 4, 12, 13, 14, 15, etc.) equipment design will not require extensive development. Operation and maintenance will likely be less problematic than higher technology (e.g., fluidization) equipment designs.

17. Continual removal of heat permits relatively low gasification temperature of 1100° F.–1300° F. and avoids significant mineral carbonate decomposition and generation of $NO_x$.

Though undesirable in most applications, the helix kiln could also be operated in cocurrent mode if the interflight baffles are not included. It would not need to be on an incline in that case and both streams of solids would move in the same direction.

The hull and interfacing shell preferably have circular cross sections, but they could have other shapes also, some of which might increase the interfacing shell area and possibly eliminate the need for baffles.

Those who are skilled in the art will readily perceive how to modify the invention. Therefore, the appended claims are to be construed to cover all equivalent structures which fall within the true scope and spirit of the invention.

The claimed invention is:

1. A rotating kiln comprising an elongated hollow vessel defining an outer container through which a first stream of solid particle material moves, a fluted interfacing shell with major and minor diameters providing a high surface-to-volume ratio, assembled inside of said hollow vessel wherein a second stream of solid particle material moves through said fluted interfacing shell counter-current to, and without mixing with, the first particle stream, a susbtantial amount of heat being transferred between the two streams and through the interfacing wall formed by said fluted interfacing shell, at least one of said strams of material being moved by means of an Archimedes screw action and means for mounting said kiln for rotation about a centre axis of rotation, each of said streams moving through the kiln responsive to the rotation of said kiln.

2. The kiln of claim 1 wherein said fluted interfacing shell comprises at least part of the wall of a helical tube.

3. The kiln of claim 2 wherein said axis of rotation is tipped with respect to the horizontal, said fluted interfacing shell having successive flights, with spolier baffles attached on one side of the fluted interfacing shell and between said successive flights in order to interrupt the Archimedes flow action of a stream on said one side of said interfacing shell and this achieve a gravity motivated flow of said one stream which is counter to the flow of said other stream on the opposite side of said interfacing wall.

4. The kiln of claim 3 wherein said axis of rotation is tipped with respect to the horizontal, by an angle in the range of substantially 0° to 40°.

5. The kiln of claim 3 wherein said spoiler baffles are attached inside the kiln between successive flights of said helical tube.

6. The kiln of claim 1 and mixing baffles on at least one side of said fluted interfacing shell forming a means for tumbling and mixing the particle material being transported through said kiln by said Archimedes screw action.

7. The kiln of claim 2 wherein said elongated hollow vessel is a cylinder with its axis of rotation tipped off the horizontal to give the kiln upper and lower ends, the upper end of said kiln being closed, and incoming and outgoing streams of said particle matter being introduced into and removed from the lower end of said kiln.

8. The kiln of claim 1 wherein at least one end of said kiln has a helical passageway which is constructed with a cross section which is smaller than the cross section of the passageway in the rest of the kiln so that the solid particle material in said smaller cross section forms at least one fluid lock by substantially filling a bottom cross section of said helical passageway.

9. The kiln of claim 1 wherein said kiln is open on both ends to enable a passage of said two streams through said kiln with heat transfer and no particle mixing between the two streams.

10. The kiln of claim 1 wherein said fluted interfacing shell has a flute pitch angle of 0°, the interfacing shell comprising a series of small diameter short cylindrical sections alternately interposed between larger diameter short cylindrical sections which are interconnected with annular walls on both sides of each of said cylindrical sections, with auger blades on at least one side of said interfacing shell whereby at least one of said particle streams moves through approximately the length of the kiln responsive to the rotation of said kiln.

11. A rotating kiln comprising an outer hollow vessel having input and output openings at one end and being essentially closed on the other end, means for transporting solid particle matter from said input opening as a first stream moving toward the closed end of said vessel, means responsive to said first stream reaching approximately the closed end of said vessel for transporting said particle matter from said closed end as a second stream moving toward said output, and a fluted interfacing shell means having a heat transfer capability for keeping the first stream completely separate from said second stream, whereby heat generated by burning solid particles in one of said streams is transferred through said interfacing shell means.

12. The kiln of claim 10 and mixing baffles attached to the interfacing shell to promote particle mixing and heat transfer.

13. The kiln of claim 11 wherein said particle material contains a significant amount of organic substances, means for introducing oxygen or air and means for a controlled oxidation of at least some of said organic substances whereby at least a significant fraction of the processing heat is generated.

14. The kiln of claim 11 wherein said particle material contains a significant amount of organic substances which are pyrolyzed and the pyrolyzate gas is removed from the kiln by means of a vapor exit pipe located approximately along the rotational axis of the kiln and extending out of said inlet/outlet end of the kiln.

15. The kiln of claim 14 and means for introducing an incoming stream of water or steam into said kiln counter-current to the flow of pyrolysis gas and water vapor flowing out of said vapor exit pipe, said inlet flow of water or stream being conducted through a conduit in contact with said vapor exit pipe, said water or stream flow being conducted nearly to the pyrolysis gas entrance, thereupon mingling the water or steam with the pyrolysis gas, there being significant heat transfer from the effluent pyrolysis gas to the inflowing water or steam and a rapid temperature reduction in the pyrolysis gas immediately prior to and during flow out the exit pipe.

16. A process for transferring heat between a pair of counterflowing streams of solid particle materal, said process comprising the steps of:

(a) passing a first stream of said solid particle material through an enclosure containing at least one fluted interface wall, said first stream remaining on one side of said wall;

(b) returning a second stream of said particle material through said enclosure, said second stream remaining on the other side of said wall; and (c) rotating said enclosure and fluted interfacing wall as a unit, the transfer of heat being from one stream through said interface wall to the other stream.

17. The process of claim 16 and the added steps of:

(d) passing a fluid inside the enclosure for a distance of approximately two flights of a helical passageway formed to provide a lock for separating fluids on both sides of the lock, and said enclosure having a sufficient capacity to cause a small amount of said fluid to flow with and counter to said particle stream; and (e) making a discrete separation of each of the two fluid streams associated with each of the solid particle streams.

18. The kiln of claim 1 wherein said kiln is closed on one end and open on the other end, a stream of solid particle material entering said open end and moving on one side of said interfacing shell through substantially the length of said kiln, then passing to the other side of said fluted interfacing shell near the closed end of said kiln, and returning on the other side of said fluted interfacing shell to the open end, the particle material on at least one side of said fluted interfacing shell being moved by means of said Archimedes screw action.

19. The kiln of claim 18 wherein the Archimedes screw action is achieved responsive to a rotation of the kiln and of the auger blades therein.

20. The kiln of claim 1 wherein the fluted interfacing shell consists of a helical tube located inside of an essentially cylindrical vessel with the same approximate major diameter as the outer vessel diameter, and said archimedes screw action is obtained by means of the helical tube and granular solid material therein.

* * * * *